US011741879B2

(12) United States Patent
Chen et al.

(10) Patent No.: US 11,741,879 B2
(45) Date of Patent: Aug. 29, 2023

(54) METHOD, DEVICE AND APPARATUS FOR BRIGHTNESS COMPENSATION OF DISPLAY PANEL

(71) Applicant: Kunshan New Flat Panel Display Technology Center Co., Ltd., Jiangsu (CN)

(72) Inventors: Feng Chen, Kunshan (CN); Junhui Lou, Kunshan (CN); Xiaoyu Gao, Kunshan (CN)

(73) Assignee: Kunshan New Flat Panel Display Technology Center Co., Ltd., Kunshan (CN)

( * ) Notice: Subject to any disclaimer, the term of this patent is extended or adjusted under 35 U.S.C. 154(b) by 0 days.

(21) Appl. No.: 17/855,009

(22) Filed: Jun. 30, 2022

(65) Prior Publication Data

US 2022/0335876 A1 Oct. 20, 2022

Related U.S. Application Data

(63) Continuation of application No. PCT/CN2021/094989, filed on May 20, 2021.

(30) Foreign Application Priority Data

Jul. 29, 2020 (CN) ..... 202010746082.X

(51) Int. Cl.
*G09G 3/20* (2006.01)

(52) U.S. Cl.
CPC ... *G09G 3/2074* (2013.01); *G09G 2320/0233* (2013.01); *G09G 2320/0626* (2013.01); *G09G 2320/0686* (2013.01)

(58) Field of Classification Search
CPC ..... G09G 3/2074; G09G 2320/0233; G09G 2320/0626; G09G 2320/0686;
(Continued)

(56) References Cited

U.S. PATENT DOCUMENTS 11,056,044 B2 * 7/2021 Huang ..... G09G 3/2085
2019/0384561 A1 * 12/2019 Jung ..... G09G 3/20
(Continued)

FOREIGN PATENT DOCUMENTS

CN 106662750 A 5/2017
CN 108766347 A 11/2018
(Continued)

OTHER PUBLICATIONS

International Search Report and Written Opinion of the International Searching Authority dated Aug. 11, 2021, in corresponding to International Application No. PCT/CN2021/094989; 13 pages (with English Translation).
(Continued)

*Primary Examiner* — Ricardo Osorio
(74) *Attorney, Agent, or Firm* — Maier & Maier, PLLC

(57) ABSTRACT

The present application discloses a method, device, and apparatus for brightness compensation of a display panel. The display panel has a first display region and a second display region. The method includes selecting at least one first region in the second display region close to the first display region; obtaining current brightness values of sub-pixels in the at least one first region under a target grayscale value; determining an average brightness value of the at least one first region based on the current brightness values of the sub-pixels in the at least one first region; determining a target brightness value of the first display region under the target grayscale value according to the average brightness value; performing brightness compensation on the first display region based on the target brightness value.

20 Claims, 8 Drawing Sheets

(58) Field of Classification Search
CPC ..... G09G 2360/145; G09G 2630/16; G09G 3/20; G09G 5/10
See application file for complete search history.

(56) References Cited

U.S. PATENT DOCUMENTS

| | | | | |
|---|---|---|---|---|
| 2020/0066809 | A1 | 2/2020 | Liu | |
| 2020/0089004 | A1* | 3/2020 | Connor | G02B 27/0176 |
| 2020/0234634 | A1* | 7/2020 | Li | G09G 3/3208 |
| 2021/0166654 | A1* | 6/2021 | Yu | G09G 5/10 |
| 2022/0036792 | A1* | 2/2022 | Chen | G09G 3/2003 |

FOREIGN PATENT DOCUMENTS

| | | | | | |
|---|---|---|---|---|---|
| CN | 110264950 | A | | 9/2019 | |
| CN | 110349543 | A | | 10/2019 | |
| CN | 110619836 | A | | 12/2019 | |
| CN | 10706634 | A | | 1/2020 | |
| CN | 110767099 | A | | 2/2020 | |
| CN | 111816113 | A | | 10/2020 | |
| CN | 114120906 | A | * | 3/2022 | |
| TW | 201939481 | A | * | 10/2019 | G09G 3/20 |

OTHER PUBLICATIONS

The First Office Action dated Mar. 4, 2022, corresponding to Chinese Application No. 202010746082.X, 16 pages (with English Translation).
The Decision of Refusal dated Sep. 14, 2022, in connection with Chinese Application No. 202010746082.X (7 pages including partial English translation).

* cited by examiner

METHOD, DEVICE AND APPARATUS FOR BRIGHTNESS COMPENSATION OF DISPLAY PANEL

CROSS-REFERENCE TO RELATED APPLICATION

This application is a continuation of International Application No. PCT/CN2021/094989, filed on May 20, 2021, which claims priority to Chinese Patent Application No. 202010746082.X, filed on Jul. 29, 2020, both of which are hereby incorporated by reference in their entireties.

TECHNICAL FIELD

The present application relates to a technical field of display computing, and in particular to a method, device, and apparatus for brightness compensation of a display panel.

BACKGROUND

With the rapid development of electronic devices, demands of users for the screen-to-body ratio are higher and higher, resulting in that the full-screen display of electronic devices attracts more and more attention in the industry.

At present, the design of the under-screen camera has appeared. Usually, the display brightness of the region corresponding to the camera is inconsistent with the display brightness of the normal display region of the display screen. Therefore, it is necessary to perform brightness compensation on the region corresponding to the camera, so that the consistency of the display brightness of the region corresponding to the camera and the display brightness of the normal display region of the display screen may be improved. Thus, in the compensation process, how to determine the target brightness of the region corresponding to the camera is particularly important.

SUMMARY

In a first aspect, the embodiments of the present application provide a method for brightness compensation of a display panel, the display panel having a first display region and a second display region, the method including: selecting at least one first region in the second display region close to the first display region; obtaining current brightness values of sub-pixels in the at least one first region under a target grayscale value; determining an average brightness value of the at least one first region based on the current brightness values of the sub-pixels in the at least one first region; determining a target brightness value of the first display region under the target grayscale value according to the average brightness value; performing brightness compensation on the first display region based on the target brightness value.

In a second aspect, the embodiments of the present application provide a device for brightness compensation of a display panel having a first display region and a second display region, including: a selection module configured to select at least one first region in the second display region close to the first display region; a brightness obtaining module configured to obtain current brightness values of sub-pixels in each first region under a target grayscale value; an average brightness determination module configured to determine an average brightness value of the at least one first region based on the current brightness values of the sub-pixels in each first region; a target brightness determination module configured to determine a target brightness value of the first display region under the target grayscale value according to the average brightness value of the at least one first region; a compensation module configured to perform brightness compensation on the first display region according to the target brightness value.

In a third aspect, the embodiments of the present application provide an apparatus for brightness compensation of a display panel, including a processor and a memory having a computer program stored thereon and executable by the processor, the computer program when executed by the processor implementing the method for brightness compensation of a display panel according to any embodiment of the first aspect.

DETAILED DESCRIPTION

Features and exemplary embodiments of various aspects of the present application will be described in detail below. In order to make the objects, technical solutions and advantages of the present application clear, the present application will be further described in detail below in conjunction with the drawings and embodiments. It should be understood that the specific embodiments described herein are only configured for explaining the present application, and not configured for limiting the present application. For a person skilled in the art, the present application may be implemented without some of these specific details. The following descriptions of the embodiments are merely to provide a better understanding of the present application by illustrating the examples of the present application.

The display panel in the embodiments of the present application may be an organic light emitting diode (OLED) display panel, or a liquid crystal display panel, which is not limited herein.

Figure 1:
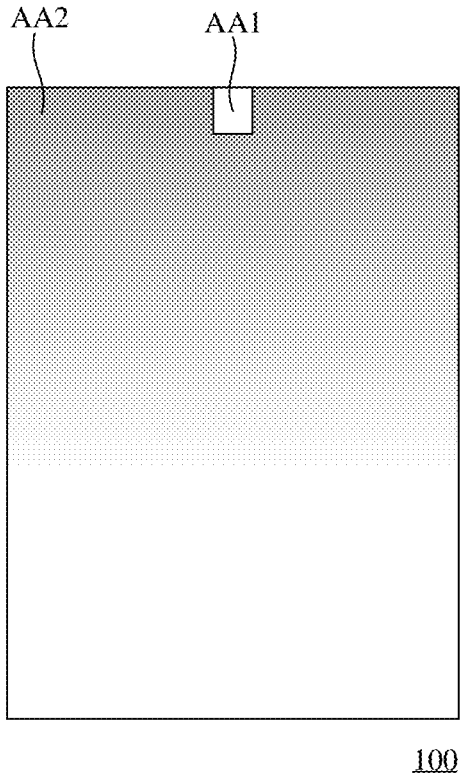
FIG. 1 illustrates a schematic structural diagram of a display panel provided by an example.

As shown in FIG. 1, the display panel 100 has a first display region AA1 and a second display region AA2. The light transmittance of the first display region AA1 may be greater than the light transmittance of the second display region AA2. The first display region AA1 is a transparent display region, which can be regarded as a secondary screen region of the display panel. The second display region AA2 can be regarded as a main screen region of the display panel.

In some examples, the light transmittance of the first display region AA1 may be 15% or more. In order to ensure that the light transmittance of the first display region AA1 is greater than 15%, greater than 40%, or even higher, the light transmittance of each of the functional film layers of the display panel in this embodiment may be greater than 80%, and the light transmittance of at least some of the functional film layers may be even greater than 90%.

Photosensitive components can be integrated on the back side of the first display region AA1 of the display panel of the embodiments of the present application, thereby achieving the under-screen integration of the photosensitive components, such as a camera. The first display region AA1 can also display images, which increases the display area of the display panel and realizes the full-screen design of the display device.

In order to ensure that the light transmittance of the first display region AA1 can meet the standard requirements, the pixel density and the pixel circuit structure design in the first display region AA1 are different from those in the second display region AA2. Due to the difference between the first display region AA1 and the second display region AA2, the visual brightness of the first display region AA1 and the visual brightness of the second display region AA2 are different. The visual brightness of the first display region AA1 refers to the brightness of the first display region AA1 perceived by human eyes. The visual brightness of the second display region AA2 refers to the brightness of the second display region AA1 perceived by human eyes. In order to improve the display effect, Demura compensation can be performed on the display panel, so as to reduce the difference between the visual brightness of the first display region AA1 and the visual brightness of the second display region AA2 and improve the display effect.

In the Demura compensation process for eliminating the brightness difference between the first display region and the second display region, the average brightness value of the entire second display region may be used as the target brightness value of the first display region. However, various regions of the second display region also have different degrees of brightness differences. As shown in FIG. 1, in the second display region, some regions adjacent to the first display region are darker, while some regions far away from the first display region are brighter. At this time, if the average brightness value of the entire second display region is still used as the target brightness value of the first display region, it will cause over compensation to the first display area, resulting in the compensated brightness of the first display region is higher than the brightness of the portion of the second display region around the first display region.

In order to solve the above-mentioned problems, the embodiments of the present application provide a method, device, and apparatus for brightness compensation of a display panel. Various embodiments of the method, device, and apparatus for brightness compensation of the display panel will be described in detail with reference to the accompanying drawings.

Figure 2:
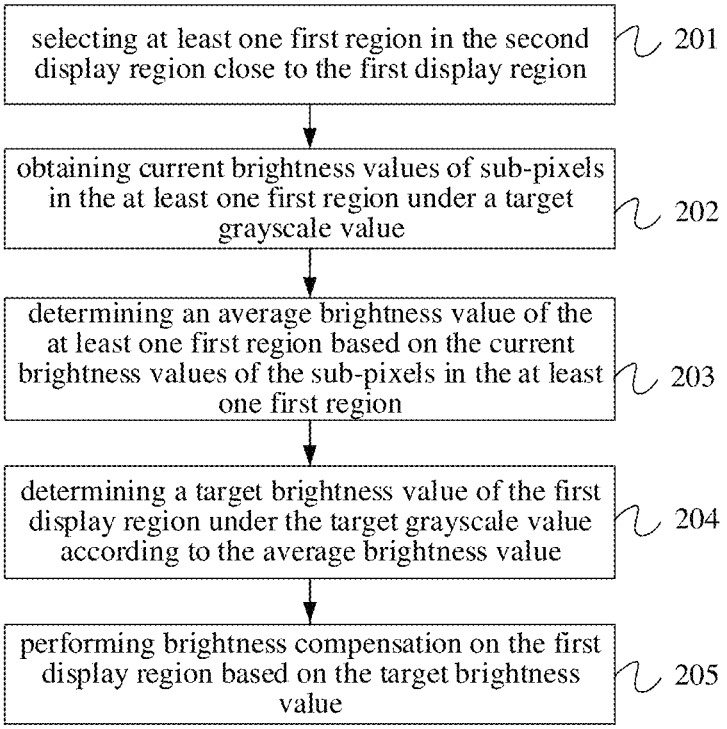
FIG. 2 illustrates a schematic flowchart of a method for brightness compensation of a display panel provided by an embodiment of the present application.

The embodiments of the present application provide a method for brightness compensation of a display panel. As shown in FIG. 2, the method for brightness compensation of the display panel may include steps 201 to 205.

In step 201: selecting at least one first region in the second display region close to the first display region.

In step 202: obtaining current brightness values of sub-pixels in the at least one first region under a target grayscale value.

In step 203: determining an average brightness value of the at least one first region based on the current brightness values of the sub-pixels in the at least one first region.

In step 204: determining a target brightness value of the first display region under the target grayscale value according to the average brightness value.

In step 205: performing brightness compensation on the first display region based on the target brightness value.

According to the method for brightness compensation of the display panel provided by the embodiments of the present application, at least one first region in the second display region close to the first display region are selected. Further, the target brightness value of the first display region under the target grayscale value is determined according to the average brightness value of the at least one first region, and then the brightness compensation may be performed on the first display region. According to the embodiments of the present application, the first region is adjacent to the first display region, that is, the first region is located around the first display region. Therefore, the target brightness value of the first display region may be determined according to the brightness of a portion of the second display region around the first display region. Thus, the display brightness of the first display region and the display brightness of the portion of the second display region around the first display region may tend to be consistent, thereby improving the brightness uniformity of the first display region and the portion of the second display region around the first display region.

In step 201, the selecting at least one first region in the second display region close to the first display region includes selecting the first region adjacent to the first display region, which can be understood as the distance between the first region and the first display region is relatively short. That is, the first region is a region of the second display region around the first display area.

Figure 3:
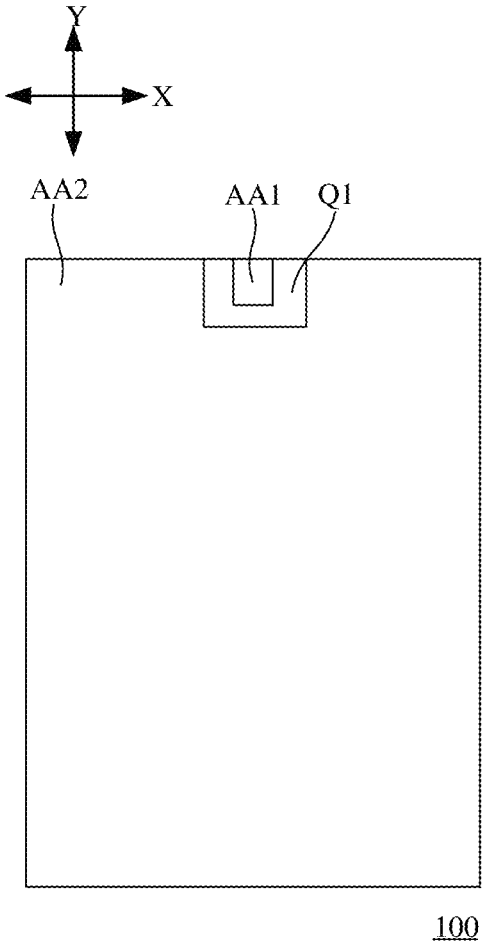
FIG. 3 illustrates a schematic diagram of a location of a first region provided by an example of the present application.

In some optional embodiments, there may be one selected first region. Step 201 may specifically include selecting one first region in the second display region close to the first display region, and at least part of the first region surrounds the first display region. Exemplarily, as shown in FIG. 3, the first display region AA1 and the second display region AA2 constitute the display region of the display panel 100. The first display region AA1 is a rectangular region, and one edge of the first display region AA1 is an edge of the display region of the display panel 100. A part of the first region Q1 surrounds the first display region AA1, that is, the first region Q1 is located around the first display region AA1. The first region Q1 may be a "concave" shaped region as a whole.

In this way, the target brightness value corresponding to the first display region can be determined only by obtaining the brightness value of one first region. Therefore, the display brightness of the first display region and the display brightness of the first region around the first display region may tend to be consistent, thereby avoiding the significant brightness difference between the first display region and the second display region. Moreover, only obtaining the brightness value of one first region is simple and convenient, which can improve efficiency.

Figure 4:
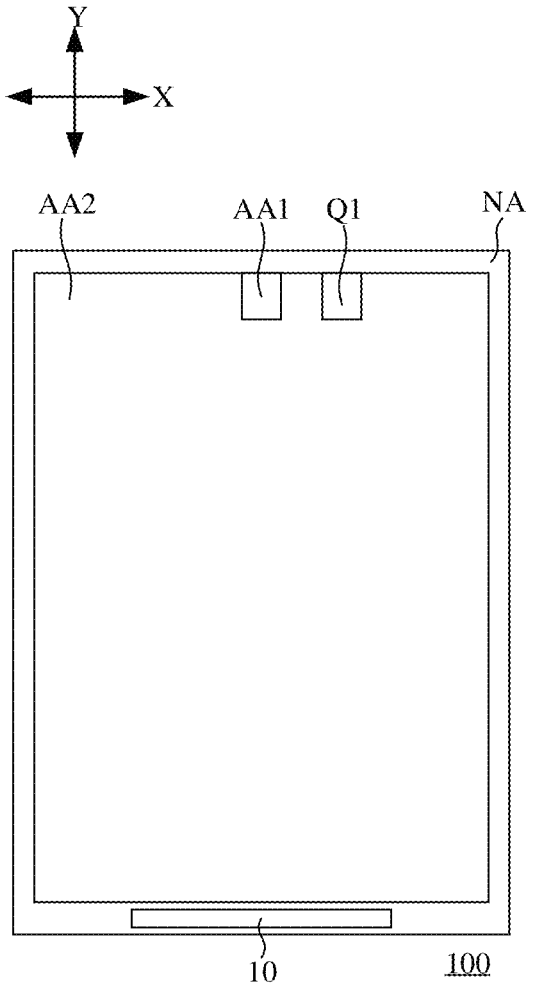
FIG. 4 illustrates a schematic diagram of a location of a first region provided by another example of the present application.

In some optional embodiments, as shown in FIG. 4, the display panel 100 may further include a non-display region NA. The non-display region NA is disposed around the display region of the display panel 100. The display panel 100 includes a driving circuit 10. The driving circuit 10 of the display panel 100 is located in the non-display region NA of the display panel 100, and is located on either side of the first display region AA1 in a second direction Y. In FIG. 4, the driving circuit 10 is disposed away from the first display region AA1. The driving circuit 10 may be an integrated circuit (IC) chip.

The driving circuit 10 may be electrically connected to signal lines of the display panel 100, and provide light-emitting signals to the sub-pixels of the display panel 100 through the signal lines, so that the display panel 100 displays a preset image. Exemplarily, the signal lines may extend along the second direction Y. Exemplarily, the signal lines may be data lines, power (Vdd) lines, and the like. In a direction away from the driving circuit 10, the voltage drops on the signal lines gradually increase, and the voltage drops at positions in the signal lines having a same vertical distance from the driving circuit 10 in the second direction Y are the same. Therefore, the brightness of the regions having a same vertical distance from the driving circuit 10 in the second direction Y may be usually consistent, while the brightness of the regions having different vertical distances from the driving circuit 10 in the second direction Y may be different due to different voltage drops.

In some optional embodiments, there may be one selected first region. Step 201 may specifically include selecting one first region in the second display region close to the first display region, and the first region is located on either side of the first display region in a first direction. Here, the first direction is a row direction of the display panel, and the second direction is a column direction of the display panel.

Please continue to refer to FIG. 4, the one selected first region Q1 is located on the right side of the first display region AA1. Of course, the one selected first region Q1 may also be located on the left side of the first display region AA1. The first region Q1 is arbitrarily selected on the left and right sides of the first display region AA1. In this way, the voltage drops of the signal lines in the first region Q1 and the first display region AA1 are equal. Therefore, the selected first region Q1 is more in line with the actual situation of the first display region AA1, and then the target brightness value of the first display region AA1 determined according to the brightness value of the first region Q1 is more accurate.

Figure 5:
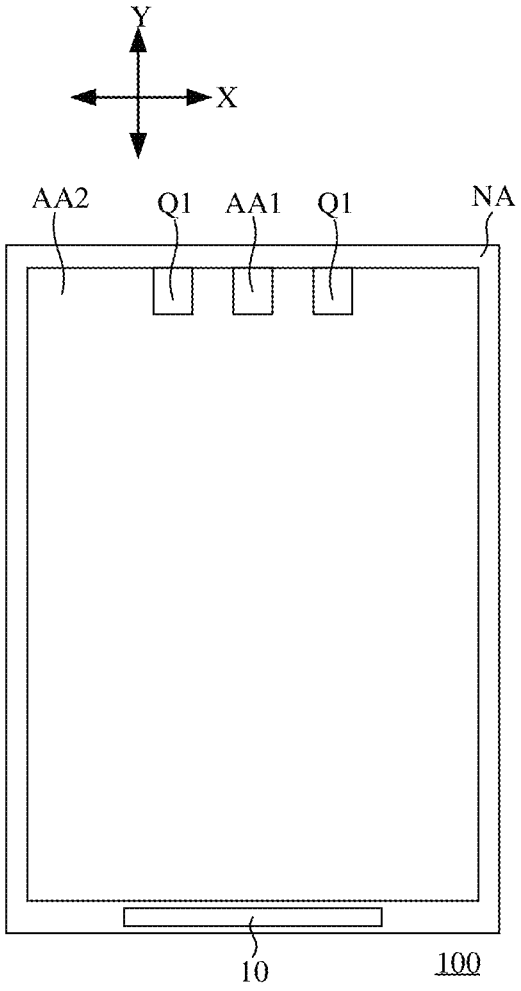
FIG. 5 illustrates a schematic diagram of a location of a first region provided by another example of the present application.

Please refer to FIG. 5, there may be two selected first regions. Step 201 may specifically include selecting two first regions in the second display region close to the first display region, and the two first regions are located on two sides of the first display region in a first direction respectively. As shown in FIG. 5, the two first regions Q1 are located on the left and right sides of the first display regions AA1 respectively. The target brightness value of the first display region AA1 is determined according to the regions on the left and right sides of the first display region AA1. In the actual compensation process, the brightness consistency of the first display region AA1 and the regions on the left and right sides of the first display region AA1 can be considered simultaneously.

Figure 6:
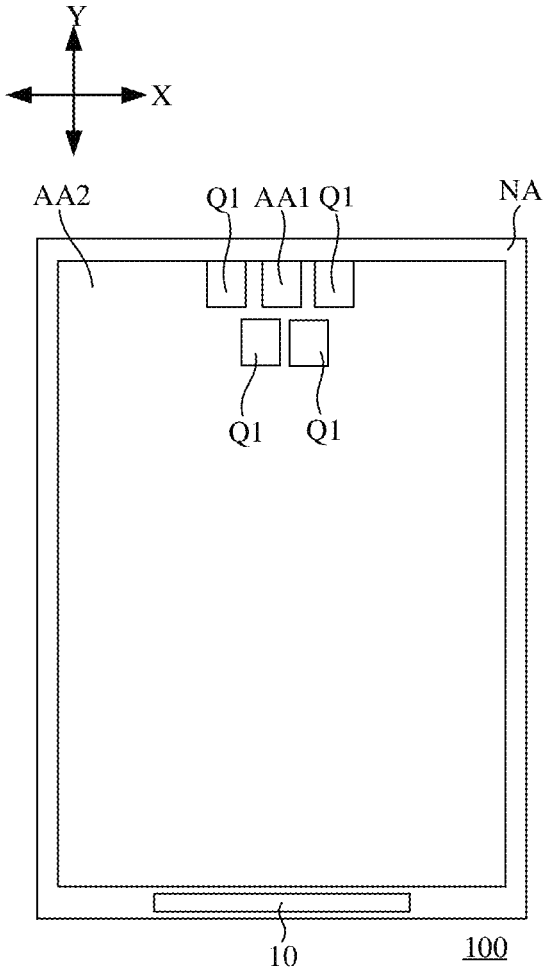
FIG. 6 illustrates a schematic diagram of a location of a first region provided by another example of the present application.

In some optional embodiments, there may be three or more selected first regions. Step 201 may specifically include selecting three or more first regions in the second display region close to the first display region, and the three or more first regions surround the first display region. Exemplarily, the three or more selected first regions may be evenly distributed around the first display region. Referring to FIG. 6, four first regions Q1 are selected, and the four first regions Q1 are distributed around the first display region AA1. Two of the four first regions Q1 can be distributed on the left and right sides of the first display region AA1, and the other two of the four first regions Q1 is located below the first display region AA1. In this way, the target brightness value of the first display region AA1 is determined according to the three or more first regions distributed around the first display region AA1. In the actual compensation process, the brightness consistency of the first display region AA1 and the regions distributed around the first display region AA1 can be considered simultaneously. It can be understood that in the actual compensation process, the more first regions are selected, the better the brightness consistency between the first display region and the regions distributed around the first display region AA1 are achieved.

In some optional embodiments, as shown in FIG. 4 to FIG. 6, the selecting one first region in the second display region close to the first display region includes selecting the first region having the same shape and size as the shape and size of the first display region. In this way, the obtained brightness value of the first region is more in line with the actual situation of the first display region AA1, so that the target brightness value required for brightness compensation for the first display region AA1 can be more accurately determined.

In some optional embodiments, the first region may be adjacent to the first display region. That is, as shown in FIG. 3, there is no space between the first display region AA1 and the first region Q1. In this way, the consistency of the display brightness of the first display region and the display brightness of the portion of the second display region around the first display region can be further ensured.

Exemplarily, in step 202, the target grayscale value may be any grayscale that can be displayed by the display panel. For example, the grayscale range of the display panel can be 0-255, and the target grayscale value can be any value within 0-255. For example, in the process of brightness compensation for the display panel, the compensation parameters corresponding to some specified grayscale binding points may be determined firstly, and then the compensation parameters corresponding to grayscales other than the grayscale binding points may be determined by a linear interpolation method. Specifically, the target grayscale value may be any one of grayscale 32, grayscale 64, grayscale 96, grayscale 128, grayscale 160, grayscale 192, grayscale 224, and grayscale 255.

In some embodiments, the first display region and the second display region may include sub-pixels of at least three colors. For example, both the first display region and the second display region include red sub-pixels, green sub-pixels and blue sub-pixels.

Exemplarily, before step 202, a first grayscale picture may be input to the display panel to light up the display panel. Specifically, the first grayscale picture may be a monochrome picture. For example, a first grayscale red picture, a first grayscale green picture, and a first grayscale blue picture may be respectively input to the display panel to determine the compensation parameters corresponding to the red sub-pixels, the green sub-pixels and the blue sub-pixels of the first display region respectively.

After the display panel is light up, the image acquisition device installed on the machine can be used to photograph the display panel to be compensated, so as to obtain the brightness data of the first region of the display panel, and generate comma-separated values (CSV) file. The image acquisition device may be a high-resolution and high-precision camera such as a charge coupled device (CCD) camera. The entire display region of the display panel can be photographed, that is, the photographed region includes the entire first display region and the entire second display region. Then, the current brightness values of the sub-pixels in the at least one first region under the target grayscale value may be selected from the overall brightness data. In addition, a portion of the display region of the display panel may be photographed, that is, the photographed region may only include the first region, which is not limited herein.

The CSV file may be specifically implemented as a CSV data file, that is, the CSV data file stores the current brightness values of the sub-pixels in the photographed region of the display panel under the target grayscale value. For example, the CapRas_032_B.CSV file stores the current brightness values of the blue sub-pixels in the photographed region of the display panel under the grayscale 32. For another example, the CapRas_224_R.CSV file stores the current brightness values of the red sub-pixels in the photographed region of the display panel to be compensated under the grayscale 224.

In some examples, under a condition that there are multiple selected first regions, the brightness of the sub-pixels in the multiple first regions may be obtained by photographing the display panel once, or the brightness of the sub-pixels in the multiple first regions may be obtained by photographing the display panel multiple times, which is not limited herein. For example, under a condition that there are two first regions, the current brightness values of the sub-pixels of one of the first regions under the target grayscale value is obtained by photographing the display panel for the first time. The current brightness values of the sub-pixels of the other one of the first regions under the target grayscale value is obtained by photographing the display panel for the second time. During the two photographing processes, the same exposure factors can be used.

It should be understood that the average brightness value of a certain region is not only related to the number of sub-pixels it includes and the brightness of each sub-pixel, but also related to its area. Therefore, in step 203, when calculating the average brightness value of each first region, the area of each first region should also be considered.

In step 204, under a condition that the number of the at least one first region is one, an average brightness value of the first region may be used as the target brightness value of the first display region under the target grayscale value. Under a condition that the number of the at least one first region is two or more, a total average brightness value of the two or more first regions may be calculated according to average brightness values of the two or more first regions. The total average brightness value may be used as the target brightness value of the first display region under the target grayscale value. Exemplarily, the number of the first regions is three, and the average brightness values of the three first regions are $LV_1$, $LV_2$, and $LV_3$, respectively. Then, the total average brightness value of the three first regions may be $(LV_1+LV_2+LV_3)/3$, and the $(LV_1+LV_2+LV_3)/3$ may be used as the target brightness value of the first display region under the target grayscale value.

Figure 7:
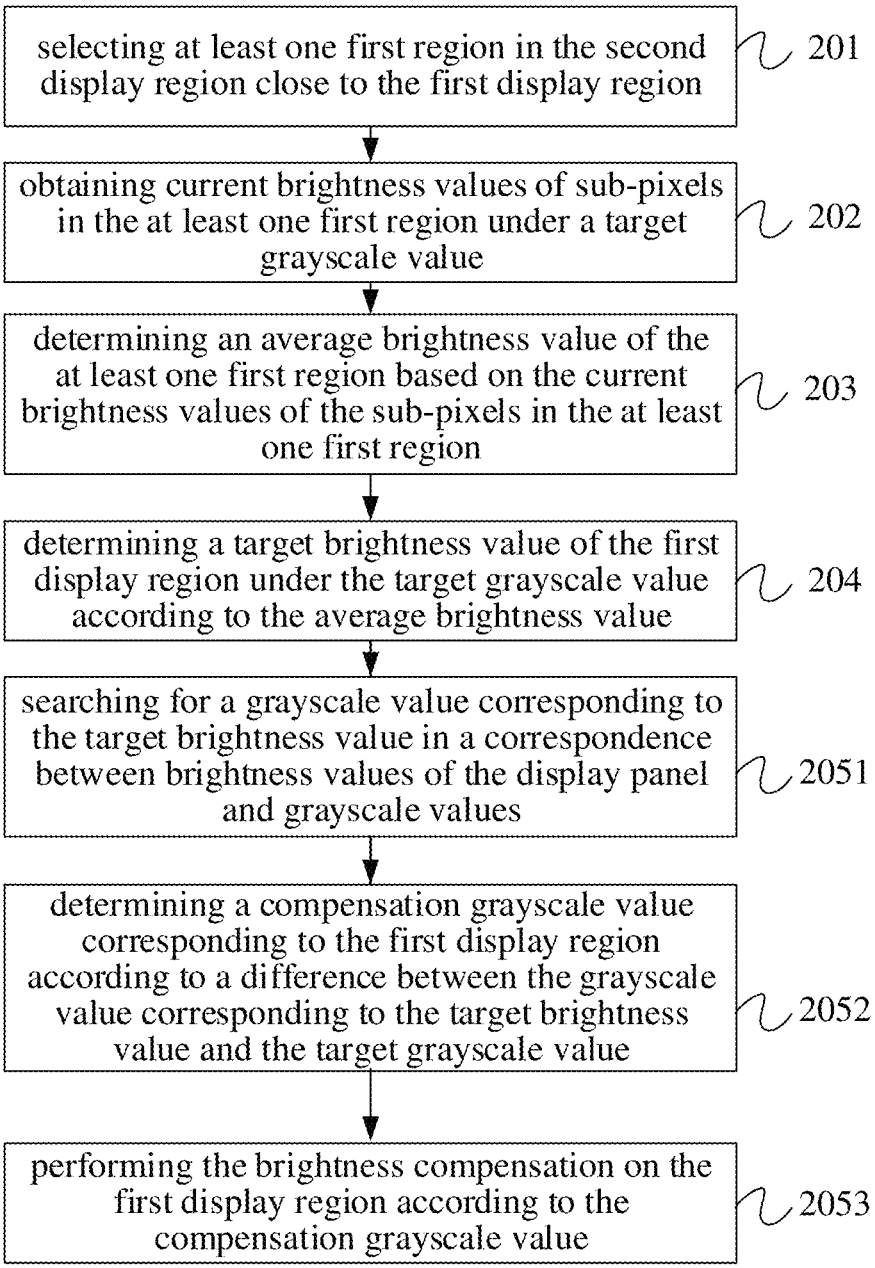
FIG. 7 illustrates a schematic flowchart of a method for brightness compensation of a display panel provided by another embodiment of the present application.

The difference between FIG. 7 and FIG. 2 is that step 205 may specifically include steps 2051 to 2053.

In step 2051: searching for a grayscale value corresponding to the target brightness value in a correspondence between brightness values of the display panel and grayscale values.

In step 2052: determining a compensation grayscale value corresponding to the first display region according to a difference between the grayscale value corresponding to the target brightness value and the target grayscale value.

In step 2053: performing the brightness compensation on the first display region according to the compensation grayscale value.

The brightness value of the display panel is positively correlated with the grayscale value, and the greater the grayscale value, the higher the corresponding brightness of the display panel. The correspondence table between brightness values of the display panel and grayscale values may be stored in advance. Exemplarily, under a condition that the target grayscale value is 64 and the grayscale value corresponding to the target brightness value is 66, the first display region is relatively dark, and the brightness of the first display region should be increased.

Usually, Demura compensation can be performed on the first display region and the second display region respectively to eliminate the Mura regions of the first display region and the second display region. Then, the brightness difference between the first display region and the second display region may be compensated. Exemplarily, the difference between the grayscale value corresponding to the target brightness value and the target grayscale value is 2. Then, each sub-pixel in the first display region may be increased by 2 grayscale. Therefore, the difference between the compensation grayscales of the sub-pixels in the first display region may be avoided, and the appearance of the Mura regions in the first display region may be avoided.

Figure 8:
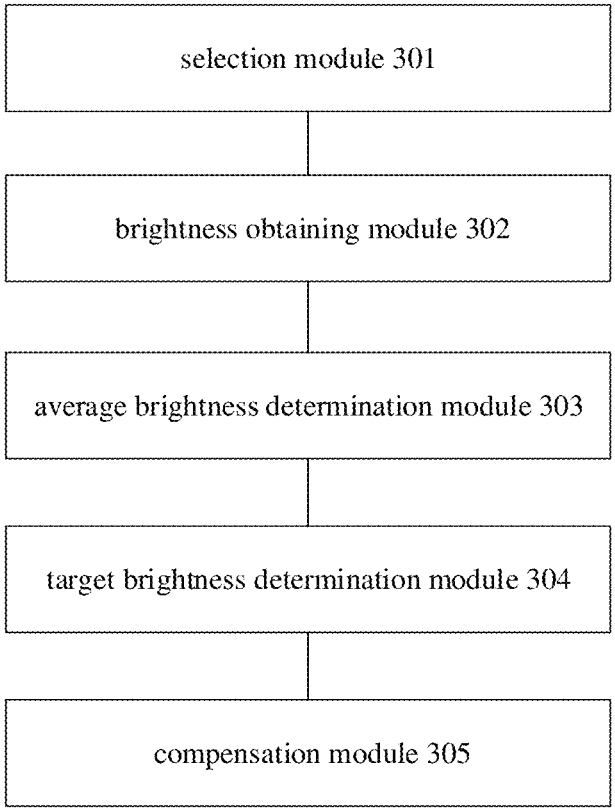
FIG. 8 illustrates a schematic structural diagram of a device for brightness compensation of a display panel provided according to an embodiment of the present application.

The embodiments of the present application also provide a device for brightness compensation of a display panel. The device for brightness compensation of the display panel can be used for the display panel in the above-mentioned embodiments. The specific content of the display panel can be referred to the relevant description in the above-mentioned embodiments, which will not be repeated here. FIG. 8 illustrates a schematic structural diagram of a device for brightness compensation of a display panel provided according to an embodiment of the present application. As shown in FIG. 8, the device for brightness compensation of the display panel may include a selection module 301, a brightness obtaining module 302, an average brightness determination module 303, a target brightness determination module 304 and a compensation module 305.

The selection module 301 is configured to select at least one first region in the second display region close to the first display region;

The brightness obtaining module 302 is configured to obtain current brightness values of sub-pixels in the at least one first region under a target grayscale value;

The average brightness determination module 303 is configured to determine an average brightness value of the at least one first region based on the current brightness values of the sub-pixels in the at least one first region;

The target brightness determination module 304 is configured to determine a target brightness value of the first display region under the target grayscale value according to the average brightness value of the at least one first region;

The compensation module 305 is configured to perform brightness compensation on the first display region according to the target brightness value.

According to the device for brightness compensation of the display panel provided by the embodiments of the present application, at least one first region in the second display region close to the first display region are selected. Further, the target brightness value of the first display region under the target grayscale value is determined according to the average brightness value of the at least one first region, and then the brightness compensation may be performed on the first display region. According to the embodiments of the present application, the first region is adjacent to the first display region, that is, the first region is located around the first display region. Therefore, the target brightness value of the first display region may be determined according to the brightness of a portion of the second display region around the first display region. Thus, the display brightness of the first display region and the display brightness of the portion of the second display region around the first display region may tend to be consistent, thereby improving the brightness uniformity of the first display region and the portion of the second display region around the first display region.

In some optional embodiments, the selection module 301 is specifically configured to select one first region in the second display region close to the first display region, wherein at least part of the first region surrounds the first display region.

The driving circuit of the display panel is located in a non-display region of the display panel and on either side of the first display region in a second direction. In some optional embodiments, the selection module 301 is specifically configured to select one first region in the second display region close to the first display region, and the first region is disposed on either side of the first display region in a first direction. Here, the first direction is a row direction of the display panel, and the second direction is a column direction of the display panel.

The driving circuit of the display panel is located in a non-display region of the display panel and on either side of the first display region in a second direction. In some optional embodiments, the selection module 301 is specifically configured to select two first regions in the second display region close to the first display region, and the two first regions are disposed on two sides of the first display region in a first direction respectively. Here, the first direction is a row direction of the display panel, and the second direction is a column direction of the display panel.

In some optional embodiments, the selection module 301 is specifically configured to select three or more first regions in the second display region close to the first display region, and the three or more first regions surround the first display region.

In some optional embodiments, the selection module 301 is specifically configured to select the first region having the same shape and size as the shape and size of the first display region.

In some optional embodiments, the selection module 301 is specifically configured to select the first region adjacent to the first display region.

In some optional embodiments, the compensation module 305 is specifically configured to search for a grayscale value corresponding to the target brightness value in a correspondence between brightness values of the display panel and grayscale values; determine a compensation grayscale value corresponding to the first display region according to a difference between the grayscale value corresponding to the target brightness value and the target grayscale value; perform the brightness compensation on the first display region according to the compensation grayscale value.

Figure 9:
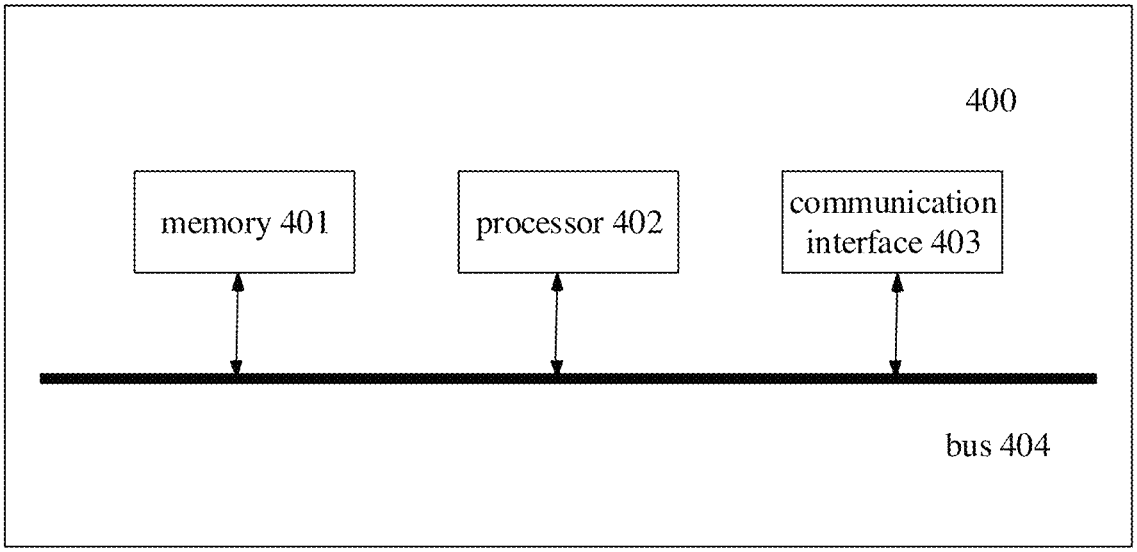
FIG. 9 illustrates a schematic structural diagram of an apparatus for brightness compensation of a display panel provided according to an embodiment of the present application.

As shown in FIG. 9, the apparatus 400 for brightness compensation includes a memory 401, a processor 402, and a computer program stored on the memory 401 and executable by the processor 402.

In one example, the above-mentioned processor 402 may include a central processing unit (CPU) or an application specific integrated circuit (ASIC), or may be configured as one or more integrated circuits implementing the embodiments of the present application.

The memory 401 may include a large-capacity memory for data or instructions. For example and without limitation, the memory 401 may include a hard disk drive (HDD), a floppy disk drive, a flash memory, an optical disk, a magneto-optical disk, a magnetic tape, or a universal serial bus (USB) drive, or a combination of two or more thereof. Where appropriate, the memory 401 may include a removable or non-removable (or fixed) medium. Where appropriate, the memory 401 may be inside or outside the apparatus 400 for brightness compensation. In a particular embodiment, the memory 401 is a non-volatile solid-state memory. In a particular embodiment, the memory 401 may be a read only memory (ROM). Where appropriate, the ROM may be a mask-programmed ROM, a programmable ROM (PROM), an erasable PROM (EPROM), an electrically erasable PROM (EEPROM), an electrically rewriteable ROM (EAROM), or a flash memory or a combination of two or more thereof.

The processor 402 reads the executable program code stored in the memory 401 and executes the computer program corresponding to the executable program code, so as to implement the method for brightness compensation in the above-mentioned embodiments.

In an example, the apparatus 400 for brightness compensation may further include a communication interface 403 and a bus 404. Here, as shown in FIG. 9, the memory 401, the processor 402, and the communication interface 403 are connected through the bus 404 and complete communication with each other.

The communication interface 403 is mainly configured to implement communication between various modules, apparatuses, units and/or devices in the embodiments of the present application. Input devices and/or output devices may also be accessed through the communication interface 403.

The bus 404 includes hardware, software, or both, and couples the components of the apparatus 400 for brightness compensation to each other. By way of example and without limitation, the bus 404 may include an accelerated graphics port (AGP) or other graphics bus, an enhanced industry standard architecture (EISA) bus, a front side bus (FSB), a hyper transport (HT) interconnection, an industry standard architecture (ISA) bus, an unlimited bandwidth interconnection, a low pin count (LPC) bus, a memory bus, a microchannel architecture (MCA) bus, a peripheral component interconnection PCI bus, a PCI-Express (PCI-X) bus, a serial advanced technology attachment (SATA) bus, a video electronics standards association local (VLB) bus or other suitable bus, or a combination of two or more thereof. Where appropriate, the bus 404 may include one or more buses. Although the embodiments of the present application describe and show a specific bus, the present application considers any suitable bus or interconnect.

The embodiments of the present application further provide a computer-readable storage medium having a computer program stored thereon. The computer program, when executed by a processor, implements the method for brightness compensation of the display panel in the above-mentioned embodiments, which can achieve the same technical effect. In order to avoid repetition, details are not repeated here. The computer-readable storage medium may include a read-only memory (ROM), a random access memory (RAM), a magnetic disk or an optical disk, which are not limited herein.

The embodiments of the present application as described above do not exhaust all the details and do not limit the scope of the present application. Obviously, those skilled in the art can make many modifications and variations in light of the above description. These embodiments are specifically described in this specification to better explain the principles and the practical applications of the present application, so that those skilled in the art can make good use of the present application and modifications based on the present application. The scope of the present application is limited only by the appended claims.

What is claimed is:

1. A method for brightness compensation of a display panel, the display panel having a first display region and a second display region, the method comprising:

selecting at least one first region in the second display region close to the first display region;

obtaining current brightness values of sub-pixels in the at least one first region under a target grayscale value by:

obtaining overall brightness data of an entire display region of the display panel;

selecting the current brightness values of the sub-pixels in the at least one first region under the target grayscale value from the overall brightness data;

determining an average brightness value of the at least one first region based on the current brightness values of the sub-pixels in the at least one first region;

determining a target brightness value of the first display region under the target grayscale value according to the average brightness value;

performing brightness compensation on the first display region based on the target brightness value.

2. The method according to claim 1, wherein the selecting at least one first region in the second display region close to the first display region includes: selecting one first region in the second display region close to the first display region, wherein at least part of the first region surrounds the first display region.

3. The method according to claim 1, wherein the display panel includes a driving circuit, and the driving circuit is disposed in a non-display region of the display panel and on either side of the first display region in a second direction, and the selecting at least one first region in the second display region close to the first display region includes: selecting one first region in the second display region close to the first display region, the first region being disposed on either side of the first display region in a first direction, wherein the first direction is a row direction of the display panel, and the second direction is a column direction of the display panel.

4. The method according to claim 1, wherein the display panel includes a driving circuit, the driving circuit is disposed in a non-display region of the display panel and on either side of the first display region in a second direction, and the selecting at least one first region in the second display region close to the first display region includes: selecting two first regions in the second display region close to the first display region, the two first regions being disposed on two sides of the first display region in a first direction respectively, wherein the first direction is a row direction of the display panel, and the second direction is a column direction of the display panel.

5. The method according to claim 3, wherein the selecting one first region in the second display region close to the first display region includes: selecting the first region having the same shape and size as the shape and size of the first display region.

6. The method according to claim 1, wherein the selecting at least one first region in the second display region close to the first display region includes: selecting three or more first regions in the second display region close to the first display region, wherein the three or more first regions surround the first display region.

7. The method according to claim 1, wherein the selecting at least one first region in the second display region close to the first display region comprises: selecting the first region adjacent to the first display region.

8. The method according to claim 1, wherein the performing brightness compensation on the first display region based on the target brightness value comprises:

searching for a grayscale value corresponding to the target brightness value in a correspondence between brightness values of the display panel and grayscale values;

determining a compensation grayscale value corresponding to the first display region according to a difference between the grayscale value corresponding to the target brightness value and the target grayscale value;

performing the brightness compensation on the first display region according to the compensation grayscale value.

9. The method according to claim 1, further comprising:

disposing the first display region having a light transmittance greater than a light transmittance of the second display region.

10. The method according to claim 1, wherein the obtaining current brightness values of sub-pixels in each first region under a target grayscale value includes: obtaining the current brightness values of the sub-pixels in each first region under the target grayscale value by photographing each first region respectively, wherein the first regions are photographed with the same exposure coefficient.

11. The method according to claim 1, wherein the determining a target brightness value of the first display region under the target grayscale value according to the average brightness value includes:

using, under a condition that the number of the at least one first region is one, an average brightness value of the first region as the target brightness value of the first display region under the target grayscale value;

calculating, under a condition that the number of the at least one first region is two or more, a total average brightness value of the two or more first regions according to average brightness values of the two or more first regions, as the target brightness value of the first display region under the target grayscale value, wherein the total average brightness value is a ratio of a sum of the average brightness values of the two or more first regions to the number of the two or more first regions.

12. The method according to claim 1, wherein the determining an average brightness value of the at least one first region based on the current brightness values of the sub-pixels in the at least one first region includes: obtaining the number of the sub-pixels, brightness of the sub-pixels and area of each of the at least one first region.

13. A method for brightness compensation of a display panel, the display panel having a first display region and a second display region, the method comprising:

selecting at least one first region in the second display region close to the first display region;

obtaining current brightness values of sub-pixels in the at least one first region under a target grayscale value;

determining an average brightness value of the at least one first region based on the current brightness values of the sub-pixels in the at least one first region;

determining a target brightness value of the first display region under the target grayscale value according to the average brightness value;

performing brightness compensation on the first display region based on the target brightness value by:

searching for a grayscale value corresponding to the target brightness value in a correspondence between brightness values of the display panel and grayscale values;

determining a compensation grayscale value corresponding to the first display region according to a difference between the grayscale value corresponding to the target brightness value and the target grayscale value;

performing the brightness compensation on the first display region according to the compensation grayscale value.

14. The method according to claim 13, wherein the selecting at least one first region in the second display region close to the first display region includes: selecting one first region in the second display region close to the first display region, wherein at least part of the first region surrounds the first display region.

15. The method according to claim 13, wherein the display panel includes a driving circuit, the driving circuit is disposed in a non-display region of the display panel and on either side of the first display region in a second direction, and the selecting at least one first region in the second display region close to the first display region includes: selecting two first regions in the second display region close to the first display region, the two first regions being disposed on two sides of the first display region in a first direction respectively, wherein the first direction is a row direction of the display panel, and the second direction is a column direction of the display panel.

16. The method according to claim 13, wherein the display panel includes a driving circuit, and the driving circuit is disposed in a non-display region of the display panel and on either side of the first display region in a second direction, and the selecting at least one first region in the second display region close to the first display region includes: selecting one first region in the second display region close to the first display region, the first region being disposed on either side of the first display region in a first direction, wherein the first direction is a row direction of the display panel, and the second direction is a column direction of the display panel.

17. A method for brightness compensation of a display panel, the display panel having a first display region and a second display region, the method comprising:

selecting at least one first region in the second display region close to the first display region;

obtaining current brightness values of sub-pixels in the at least one first region under a target grayscale value;

determining an average brightness value of the at least one first region based on the current brightness values of the sub-pixels in the at least one first region;

determining a target brightness value of the first display region under the target grayscale value according to the average brightness value by:

using, under a condition that the number of the at least one first region is one, an average brightness value of the first region as the target brightness value of the first display region under the target grayscale value;

calculating, under a condition that the number of the at least one first region is two or more, a total average brightness value of the two or more first regions according to average brightness values of the two or more first regions, as the target brightness value of the first display region under the target grayscale value, wherein the total average brightness value is a ratio of a sum of the average brightness values of the two or more first regions to the number of the two or more first regions;

performing brightness compensation on the first display region based on the target brightness value.

18. The method according to claim 17, wherein the selecting at least one first region in the second display region close to the first display region includes: selecting one first region in the second display region close to the first display region, wherein at least part of the first region surrounds the first display region.

19. The method according to claim 17, wherein the display panel includes a driving circuit, the driving circuit is disposed in a non-display region of the display panel and on either side of the first display region in a second direction, and the selecting at least one first region in the second display region close to the first display region includes: selecting two first regions in the second display region close to the first display region, the two first regions being disposed on two sides of the first display region in a first direction respectively, wherein the first direction is a row direction of the display panel, and the second direction is a column direction of the display panel.

20. The method according to claim 17, wherein the display panel includes a driving circuit, and the driving circuit is disposed in a non-display region of the display panel and on either side of the first display region in a second direction, and the selecting at least one first region in the second display region close to the first display region includes: selecting one first region in the second display region close to the first display region, the first region being disposed on either side of the first display region in a first direction, wherein the first direction is a row direction of the display panel, and the second direction is a column direction of the display panel.

* * * * *